United States Patent [19]

Lieber

[11] 4,313,362

[45] Feb. 2, 1982

[54] GUITAR CONSTRUCTION

[76] Inventor: Thomas G. Lieber, 9 E. Valley Stream Blvd., Valley Stream, N.Y. 11580

[21] Appl. No.: 114,224

[22] Filed: Jan. 22, 1980

[51] Int. Cl.[3] ..... G10D 3/00

[52] U.S. Cl. ..... 84/267; 84/291; 84/293

[58] Field of Search ..... 84/267, 291, 293, 294

[56] References Cited

U.S. PATENT DOCUMENTS

| | | | |
|---|---|---|---|
| Re. 23,620 | 2/1953 | Finder | 84/291 |
| 2,795,988 | 6/1957 | Maccaferri | 84/293 |
| 3,474,697 | 10/1969 | Kaman | 84/267 |
| 3,664,911 | 5/1972 | Takabayashi | 84/291 |
| 4,084,476 | 4/1978 | Rickard | 84/293 |
| 4,185,534 | 1/1980 | Cove | 84/291 |
| 4,213,370 | 7/1980 | Jones | 84/291 |

FOREIGN PATENT DOCUMENTS

| | | | |
|---|---|---|---|
| 697869 | 11/1964 | Canada | 84/291 |

*Primary Examiner*—L. T. Hix
*Assistant Examiner*—Alan Mathews

[57] ABSTRACT

A body having a rear panel and sides integrally formed of plastic, with a top panel secured across the upper sides, the body being connected to a neck, having a U-shaped cross section, and a peghead, integrally formed of plastic with the neck. A flat plastic panel is secured across the open side of the neck, for attachment of a fretboard, and a reinforcement rod runs from the butt end of the body to the upper portions of the peghead. Plastic foam is shot within all interior portions of the body, neck and peghead.

3 Claims, 4 Drawing Figures

FIG. 1
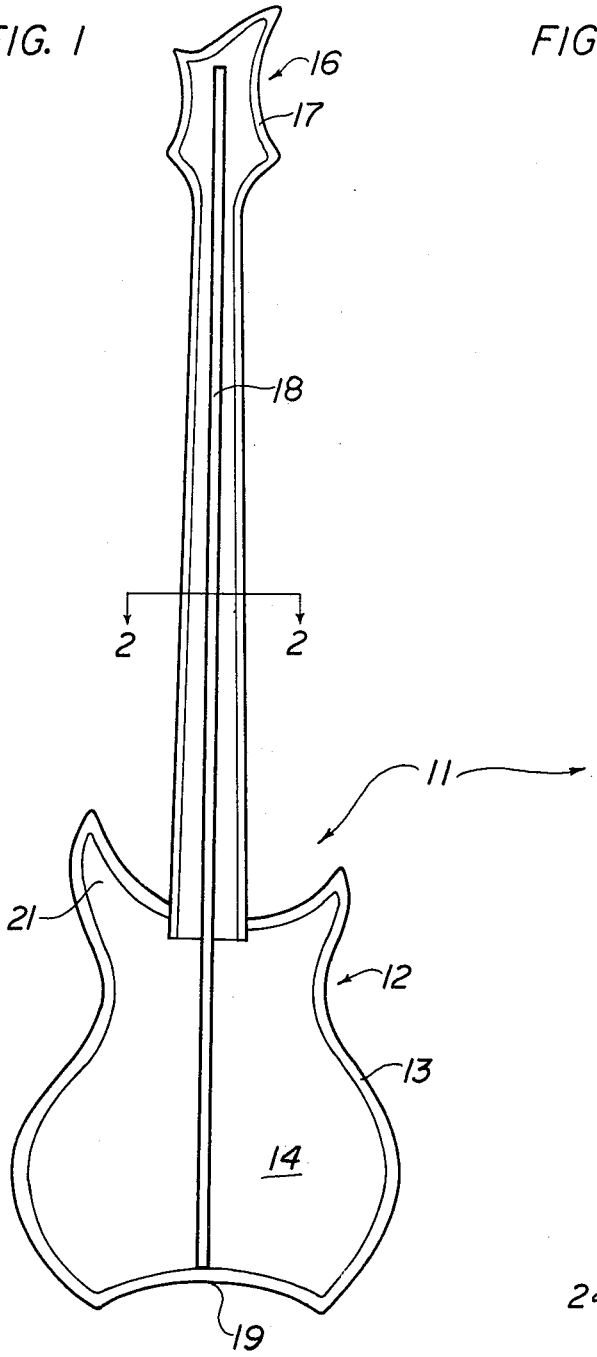
FIG. 3
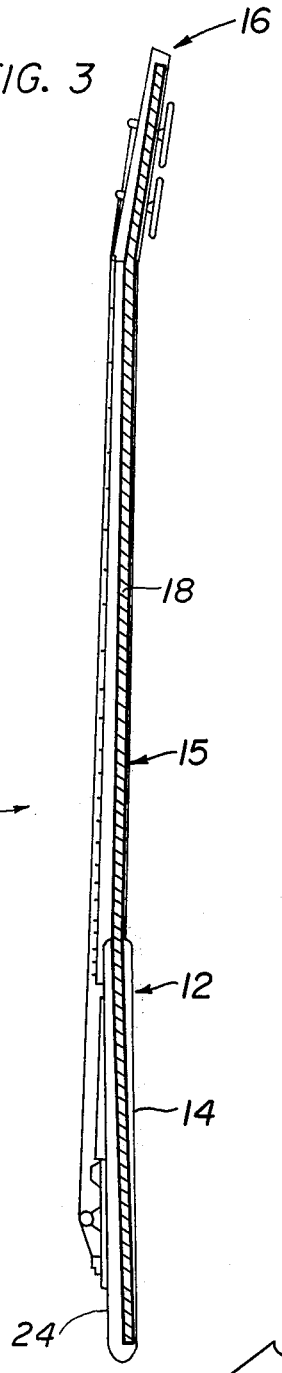
FIG. 2
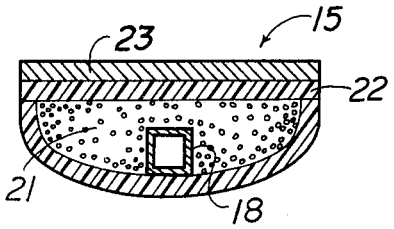
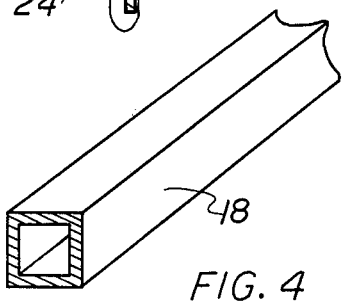
FIG. 4

GUITAR CONSTRUCTION

BACKGROUND OF INVENTION

This invention relates to electric guitars, and, more particularly, to electric guitars of plastic construction.

Electric guitars can be constructed of a variety of materials, such as wood, metal, or plastic. Plastic has been used for such construction purposes primarily because of its easier shaping characteristics, and because of its mass production possibilities. Plastic also can be advantageously used in electric guitar construction to produce a dead tone, in which all tones produced by the guitar have the same level of intensity. However, plastic guitars as presently constructed require extensive bracing, using wood or metal in the neck and/or body portions, to provide the required degree of structural rigidity. The electric guitars constructed solely of plastic are simply not strong enough to hold up over a long period of time.

A number of guitar constructions have utilized combinations of wood and plastic, or plastic on metal, both for electric and acoustic guitars. The acoustic constructions are generally not practical for electric guitars since the former require a body construction that will itself produce sound when the strings are struck, whereas the bodies of electric guitars function solely in carrying the electronic pickup equipment. At present there is available no electric guitar formed predominantly of plastic and which not only has sufficient structural rigidity but produces a completely dead tone.

SUMMARY OF THE INVENTION

In accordance with this invention there is provided an electric guitar comprising a body having a rear panel and side panel integrally formed of plastic and defining a hollow interior, with a top panel attached over the hollow interior. A neck and peghead are integrally formed of plastic and connected to the guitar body, the neck having a substantially U-shaped cross-section with its open side lying in a plane parallel to that of the top of the body, the neck having a flat plastic panel attached across its open side. A reinforcement rod, of metal, wood or plastic, is secured within the body to the rear panel thereof and extends through the interior of the neck and peghead, to a point beyond the turning machines thereof. High density plastic foam is shot within the interior portions of the body, neck and peghead, and a fretboard is attached to the flat plastic panel of the neck.

The body, neck and peghead portions of the guitar are preferably constructed of fiberglass in a thickness of from about 1/16 inch to ⅛ inch. The reinforcement rod preferably comprises aluminum square channel stock about ½ inch on each side, and the flat plastic panel is preferably formed of fiberglass in a thickness of about 1/16 inch.

It is a primary object of this invention to provide an electric guitar constructed predominantly of plastic and having superior structural rigidity.

It is another object of this invention to provide a plastic electric guitar capable of producing a dead tone.

It is a further object of this invention to provide an inexpensively manufactured plastic electric guitar exhibiting both light weight and excellent sound production characteristics.

BRIEF DESCRIPTION OF THE DRAWINGS

FIG. 1 is a top view, broken away, of the guitar construction of this invention;

FIG. 2 is a cross-sectional view taken along line 2—2 of FIG. 1;

FIG. 3 is a side elevational view of the guitar shown in FIG. 1; and FIG. 4 is a perspective view of the reinforcement rod used in the guitar shown in FIG. 1.

DESCRIPTION OF THE PREFERRED EMBODIMENT

Referring to FIG. 1 of the drawings, guitar 11 has body portion 12, having walls 13 and rear panel 14, a neck portion 15, and a peghead 16. Peghead 16 and neck 15 are integrally formed of fiberglass in a thickness of about ⅛ inch. Walls 17 carry conventional turning machines, and neck 15 is joined to body portion 12 as is known in the art. Rear panel 14 and walls 13 are integrally formed of fiberglass in a thickness ranging from about 1/16 inch to ⅛ inch. Reinforcement rod 18, formed of a one-half inch or three-eighth inch square aluminum alloy channel stock, is secured to panel 14 and extends through the interior of neck portion 15 and peghead 16 to a point beyond the location of the turning machines located thereon. Reinforcement rod 18 is secured to rear panel 14 and the bottom of neck portion 15 and peghead 16 by means of an epoxy glue, although any adhesive capable of securely affixing the reinforcement rod to the interior of the guitar would be acceptable.

Reinforcement rod 18 can be formed of any metal, wood or plastic, such as graphite, as long as it provides the required structural rigidity. Most importantly, reinforcement rod 18 must extend from the butt end 19 of guitar body 12 through the neck portion 15 and peghead 16 to a point beyond the turning machines. Such extension of the reinforcement rod is essential to obtain the production of a dead tone electric guitar, while at the same time providing a light weight guitar having a long life.

High density plastic foam 21, formed of polystyrene, polyurethane, polyethlene, and the like, is shot into all interior portions of body 12, neck 15 and peghead 16. It is the unique combination of reinforcement rod 18, high density foam 21, and the fiberglass "skin" of body 12, neck portion 15 and peghead 16 which produces an almost completely plastic guitar 11, having extremely light weight and yet being capable of producing a completely even intensity of sound, i.e., a dead tone.

Referring to FIG. 2, neck portion 15 is shown in its substantially U-shaped cross-sectional configuration, with reinforcement rod 18 secured by epoxy glue or other adhesive to the interior bottom portion thereof. High density foam 21 is shot into the interior of neck portion 15, and a flat plastic panel 22 is attached over the open side of neck portion 15, panel 22 serving as a base for application of fretboard 23, which extends from the juncture of peghead 16 to below the attachment of neck portion 5 to body portion 12. Fretboard 23 is attached over flat plastic panel 22 to complete neck portion 15. It is preferable that the fretboard remain of wood construction, since there is a need to remove the metal frets when they wear out; although in some instances, it might be desired to make fretboard 23 of plastic as well as the other guitar components.

As shown in FIG. 3, reinforcement rod 18 runs along the bottom of body portion 12, on top of rear panel 14, angles upwardly at the juncture of neck 15 with body portion 12, and continues along the bottom of neck portion 15 to peghead 16, where it angles rearwardly along the inside bottom of peghead 16. Reinforcement rod 18 is attached by epoxy glue or similar adhesive to all contacting portions of body 12, neck 15 and peghead 16, such that it provides complete structural rigidity of the entire guitar. Top panel 24 is secured over the hollow interior of body portion 12, panel 24 being formed of wood or plastic.

Referring to FIG. 4, reinforcement rod 18 is preferably a hollow metal rod, formed of an aluminum alloy or a similar light weight metal alloy, having square sides of from about $\frac{3}{8}$ inch to $\frac{1}{2}$ inch. Reinforcement rod 18 can be formed of wood or plastic, or any other rigid substance. When a metal reinforcement rod is employed, it is especially preferable that the rod be hollow as described.

There is thus provided an electric guitar formed entirely of plastic, except for reinforcement rod 18, which may be metal, and fingerboard 23, usually formed of wood. The use of reinforcement rod 18, extending from the butt of the body to the tip of the peghead, enables the body, neck and peghead portion of the guitar to be formed of a thin fiberglass skin, thereby giving the overall guitar a light weight, yet without sacrificing structural rigidity. Such construction enables guitars to be produced at significantly less cost than other partially plastic guitars using metal necks and the like. Most importantly, the improvement in structural rigidity over any existing electric guitar allows the guitars to consistently produce dead tones. That is, the guitar will provide an even tonal distribution, with no one note overpowering the others, completely eliminating the problem in presently available electric guitars where one string might vibrate above the others. In sum, the electric guitar construction of this invention is lighter and less expensive than conventional electric guitars, and provides a superior musical tone.

It is claimed:

1. An electric guitar comprising (a) a body having a rear panel and sides integrally formed of plastic and defining a hollow interior, and a top panel attached over the hollow interior, (b) a neck having a substantially U-shaped cross-section and being formed of plastic, the neck being integrally formed with the body with its open side lying in a plane parallel to that of the top of the body, the neck having a flat plastic panel attached across its open side, (c) a peg head integrally formed of plastic with the neck, the peg head having a hollow interior, (d) a fret board attached to the flat plastic panel of the neck, (e) an aluminum reinforcement rod glued within the body of the rear panel thereof and extending through the interior of the neck and peg head and being glued to the neck and peghead, and (f) high density plastic foam packed within the interior portion of the body, neck and peg head.

2. The electric guitar of claim 1 wherein the reinforcement rod runs along the rear panel of the body, angles unwardly at the juncture of the neck and continues along the interior bottom of the neck thru the peghead to a point beyond the turning machines thereof.

3. The electric guitar of claim 1 wherein the reinforcement rod is aluminum square channel stock about one-half inch on each side, and wherein the channel stock is glued to the rear panel of the body and the interior of the neck and peghead by means of epoxy glue.

* * * * *